US007526938B2

(12) United States Patent
Dunwoody et al.

(10) Patent No.: US 7,526,938 B2
(45) Date of Patent: May 5, 2009

(54) CAN MANUFACTURE

(75) Inventors: Paul Robert Dunwoody, Oxfordshire (GB); Philip Alan Marriott, Oxfordshire (GB); Sudesh Kumar Nayar, Wiltshire (GB)

(73) Assignee: CROWN Packaging Technology, Inc., Alsip, IL (US)

( * ) Notice: Subject to any disclaimer, the term of this patent is extended or adjusted under 35 U.S.C. 154(b) by 0 days.

(21) Appl. No.: 10/584,757

(22) PCT Filed: Nov. 29, 2004

(86) PCT No.: PCT/EP2004/013521

§ 371 (c)(1),
(2), (4) Date: Jun. 27, 2006

(87) PCT Pub. No.: WO2005/063587

PCT Pub. Date: Jul. 14, 2005

(65) Prior Publication Data

US 2007/0186613 A1 Aug. 16, 2007

(30) Foreign Application Priority Data

Dec. 29, 2003 (EP) ..... 03258228

(51) Int. Cl.
*B21D 11/10* (2006.01)

(52) U.S. Cl. ..... 72/379.4; 220/669; 413/2; 72/715

(58) Field of Classification Search ..... 72/347, 72/348, 349, 342.2, 342.3, 342.7, 715, 379.4; 220/669, 670, 660, 675; 413/2, 4, 69
See application file for complete search history.

(56) References Cited

U.S. PATENT DOCUMENTS

| | | | | |
|---|---|---|---|---|
| 2,208,431 | A * | 7/1940 | Rochow | 366/130 |
| 3,262,701 | A * | 7/1966 | Howland | 482/146 |
| 5,160,031 | A * | 11/1992 | Palisin et al. | 206/519 |
| 5,346,095 | A * | 9/1994 | Deal | 220/669 |
| 5,678,439 | A * | 10/1997 | Dunwoody et al. | 72/45 |
| 6,010,028 | A * | 1/2000 | Jordan et al. | 220/669 |
| 6,598,450 | B2 * | 7/2003 | Blue | 72/342.3 |
| 6,598,451 | B2 * | 7/2003 | Blue | 72/342.3 |
| 7,107,811 | B2 * | 9/2006 | Zauhar | 72/349 |

FOREIGN PATENT DOCUMENTS

| | | |
|---|---|---|
| EP | 1 029 613 A | 8/2000 |
| GB | 1 536 543 A | 12/1978 |
| JP | 63 090326 A | 4/1988 |

* cited by examiner

*Primary Examiner*—Edward Tolan
(74) *Attorney, Agent, or Firm*—Miles & Stockbridge P.C.; Vincent L. Ramik, Esq.

(57) ABSTRACT

An assembly for can manufacture includes a toolpack having coolant dies (3,4,5,6) adjacent and either side of ironing dies (1,2) so that coolant may be circulated around cavities in the coolant dies so as to cool the ironing die inserts (12). Generally, the toolpack is used in conjunction with a ram (20), coolant tube assembly (30) and ram guidance assembly (60) which together ensure that the ram is cooled along its entire length, up to and including the punch nose (21).

8 Claims, 2 Drawing Sheets

CAN MANUFACTURE

BACKGROUND OF THE INVENTION

This application is a 35 USC 371 of PCT/EP04/13521 filed Nov. 29, 2004.

This invention relates to a metal container of the type having a body which is closed at one end by a peelable membrane or foil. In particular, it relates to a can body having a separate member fixed to one end and to which the peelable component is adhered.

The usage of the sheet metal from which a container is manufactured is obviously of economic importance to the industry. For example, when the sheet metal is "blanked" to form ring-shaped components to which a peelable component is applied, the material punched out of the middle is often discarded. Systems which reuse this blanked material in forming smaller sanitary (non-processed) can ends have been implemented but are inherently limited in the maximum size of ends which can be produced. The size of the sanitary ends is also such that they cannot be used on the same container as the ring without the resultant container being "top-heavy" and unstable. If the containers used for the ring and end are manufactured in different volumes then there will still be surplus of one of these and the manufacturing and mechanical handling logistics become difficult.

This invention seeks to provide a stable container which minimises metal usage and is readily handled during manufacture, filling and on shop shelves.

SUMMARY OF THE INVENTION

According to the present invention, there is provided a metal container comprising a base, a side wall and a ring component which is adapted to be closed by a peelable membrane or foil, the base and the ring component being formed from the same sheet metal, in which the container side wall is flared outwardly at the end to which the ring component is fixed by between 6 mm and X mm, where X=0.15 times the diameter of the container side wall, has a central section of substantially constant cross-section, and is tapered inwardly at the base by between 2 mm and Y mm, where Y=0.22 times the diameter of the side wall.

Typical examples of X and Y are therefore X=11 mm and Y=16 mm for a 73 mm can side wall diameter, although different can bodies diameters may also be used. Although a side wall diameter of 150 mm is currently the largest which is likely to be used with this invention, the invention is clearly not limited in this respect.

The preferred range of flare and/or taper angle is 20° to 50° so as to minimise the length of material to be formed without compromising axial strength.

The maximum amount of flare for the upper end of the container is selected as that which provides ease of filling without risking handling difficulties on the manufacturing line or supermarket shelves. The maximum taper at the bottom end is that which is possible without risk of instability of the container. However, a minimum amount of flare/taper is required if the ring component and base are to be manufactured from the same sheet metal.

In a typical cylindrical container to hold between 80 g and 500 g of food the difference between upper diameter $D_2$ and the side wall diameter $D_1$ is from 6 mm to 12 mm and the difference between the end diameter $D_3$ and the upper diameter $D_2$ is from 14 mm to 28 mm. Preferably, the difference $D_2-D_1$ is between 10 mm and 11 mm and the difference $D_2-D_3$ is between 23 mm and 27 mm.

The ring component may generally include a flat panel to which a peelable membrane is fixable, the flat panel preferably having a seal portion with a width of 2 to 6 mm. The cut edge of the ring portion may be curled either outwardly or inwardly so as to hide the cut edge.

For optimum product release, particularly when the product is solid, such as pet food, the internal diameter of the ring component for a cylindrical container may be the same as or greater than the diameter $D_1$ of the side wall.

For such products which need to be easily removed, the diameter $D_3$ is ideally at least 15 mm smaller than the side wall diameter $D_1$ since this enables a ring component to be manufactured from the same material as the base, but having an internal ring diameter which is greater than or equal to the side wall diameter.

According to a further aspect of the present invention, there is provided a method of forming a container comprising: forming a cylindrical side wall; expanding the side wall at one end and necking the side wall at the opposite end; forming an intermediate component having a seaming panel connected by a wall to a flat annulus, a substantially cylindrical wall portion and a centre panel; cutting the centre panel out of the intermediate component and curling the cylindrical wall to form a ring component; seaming the ring component to the expanded end of the side wall and the centre panel to the necked end.

The step of forming the intermediate component may comprise forming can end features on the centre panel.

BRIEF DESCRIPTION OF THE DRAWING

A preferred embodiment of the invention will now be described, by way of example only, with reference to the drawing which is a schematic side view of one progression of forming a ring component and can end for seaming to the same can body.

DESCRIPTION OF THE PREFERRED EMBODIMENT

Figure 1A:
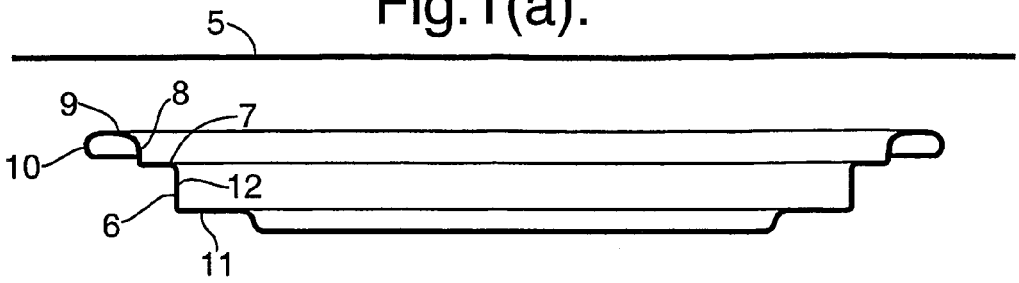
Figure 1B:
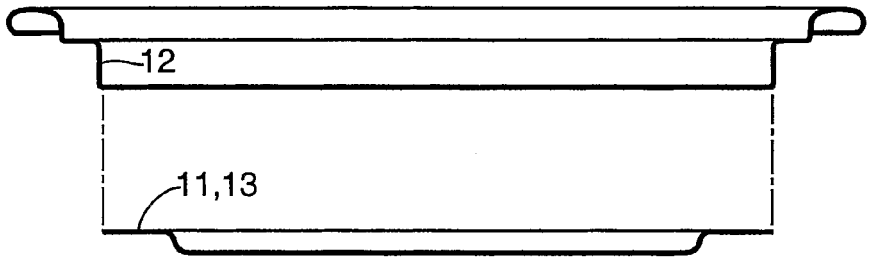
Figure 1C:
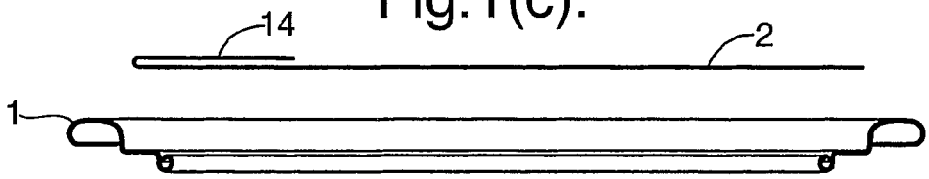
Figure 1D:
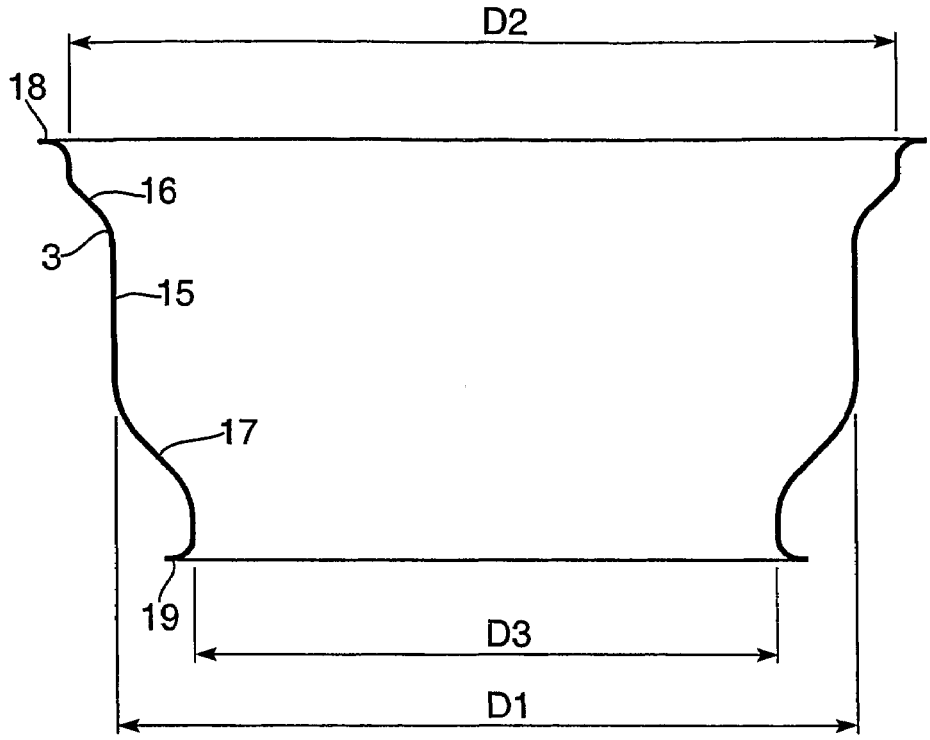
Figure 1E:
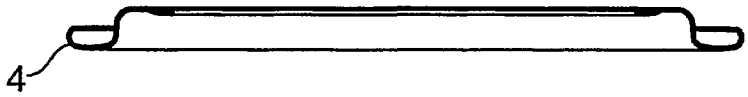
Figure 1F:
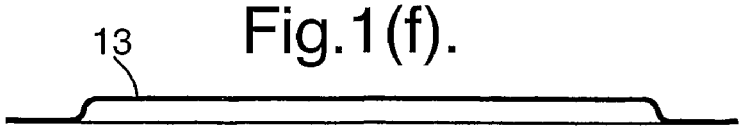

FIG. 1 shows a ring 1 for closing by a peelable foil or membrane 2, a can body 3 and sanitary end 4. With reference to FIGS. 1(*a*) to 1(*c*), ring 1 and end 4 are formed from the same sheet metal 5 by drawing the metal sheet into a shallow cup 6 with flat annular portion 7 and wall 8 extending into a seaming panel 9 and terminating in curl 10. Base 11 of the cup 6 is severed close to the cup wall 12 so as to form a stepped disc 13 which is subsequently to be used for forming the base of the container. The wall 12 is then curled adjacent annulus 7, thus forming a bond surface for fixing foil 2. In the FIG. 1(*c*) this bonding surface 7 is shown as flat but it may be inclined if desired for pressure performance purposes, for example. In one embodiment, a tab 14 may be formed from the foil 2.

As shown in FIG. 1(*d*), the can body 3 is formed from a cylinder of metal 15 which is expanded outwardly at one end 16 and necked inwardly at the opposite end 17. The body is provided with a flange 18, 19 at each end suitable for seaming the ring component 1 and can end 4 respectively.

Stepped disc 13, which was cut from the cup 6 (see FIGS. 1(*a*) and 1(*b*)) is shallow drawn, curled and then seamed to the lower end of can body 3.

In accordance with the invention, the dimensions of the features are selected so as to enable the ring 1 and end 4 to be manufactured from a single sheet of metal. In particular, dimensions are selected as defined in the claims. One container made in accordance with the invention has a 200 ml contained volume and has an 83 mm diameter peel seam ring, 73 mm body diameter and 58 mm diameter end. Another container had a 73 mm diameter ring, 65 mm diameter body and 51 mm diameter end.

The example of the FIGURE may be modified by forming the steps in a series of simple forming operations or by carrying out one or more of the steps in a single machine. Furthermore, different shapes of formed components may be made so as to allow, say, the lower side of the sheet metal 5 to become the upper side of the ring 1 whilst remaining the lower side of end 4. This is particularly useful where the coating on one side is a "soft" material selected for bonding the peelable foil to the ring, but a more robust material is preferred for the end which is in contact with the product.

What is claimed is:

1. A metal container comprising a base, an axially opposite open ended side wall and a ring component, the ring component adapted to be closed by a peelable membrane or foil, the base and the ring component being formed from the same sheet of metal and fastened to opposite ends of the axially opposite open ended side wall, in which the container side wall:

a) is flared outwardly to a diameter $D_2$ at the end to which the ring component is fixed by between 6 mm and X mm, where X=0.15 times the diameter $D_1$ of a central section of the container side wall, the central section being of a substantially constant cross-section;

and in which the container side wall:

b) is tapered inwardly to a diameter $D_3$ at the end to which the base is fixed by between 2 mm and Y mm, where Y=0.22 times the diameter $D_1$ of the central section of the container side wall.

2. The metal container as defined in claim 1 wherein the difference between diameter $D_2$ and diameter $D_1$ is from 6 mm to 12 mm and the difference between diameter $D_3$ and $D_2$ is from 14 mm to 28 mm.

3. The metal container as defined in claim 2 wherein the difference $D_2-D_1$ is between 10 mm and 11 mm and the difference $D_2-D_3$ is between 23 mm and 27 mm.

4. The metal container as defined in claim 1 wherein the ring component includes a generally flat panel to which a peelable membrane or foil is fixed, and the flat panel having a seal width of 2 mm to 6 mm.

5. The metal container as defined in claim 2 wherein an internal diameter of the ring component is substantially the same as or greater than the diameter $D_1$.

6. The metal container as defined in claim 5 wherein the diameter $D_3$ is at least 15 mm smaller than the diameter $D_1$.

7. A method of forming a container according to claim 1, comprising:

forming a cylindrical side wall;

expanding the side wall at one end and necking the side wall at the opposite end;

forming an intermediate component having a seaming panel connected by a wall to a flat annulus, a substantially cylindrical wall portion and a centre panel;

cutting the centre panel out of the intermediate component and curling the cylindrical wall to form a ring component; and seaming the ring component to the expanded end of the side wall and the centre panel to the necked end.

8. The method according to claim 7, in which the step of forming the intermediate component comprises forming can end features on the centre panel.

* * * * *